US007168455B2

(12) United States Patent
Froment

(10) Patent No.: US 7,168,455 B2
(45) Date of Patent: Jan. 30, 2007

(54) GUIDING MEMBER, JACQUARD HARNESS INCORPORATING SUCH A MEMBER, PROCESS FOR MANUFACTURING SUCH A MEMBER AND WEAVING LOOM COMPRISING SUCH A MEMBER

(75) Inventor: Jean-Paul Froment, Doussard (FR)

(73) Assignee: Staubli Lyon, Chassieu (FR)

( * ) Notice: Subject to any disclaimer, the term of this patent is extended or adjusted under 35 U.S.C. 154(b) by 481 days.

(21) Appl. No.: 10/742,954

(22) Filed: Dec. 23, 2003

(65) Prior Publication Data

US 2005/0274427 A1 Dec. 15, 2005

(30) Foreign Application Priority Data

Dec. 24, 2002 (FR) ..... 02 16663

(51) Int. Cl.

| | |
|---|---|
| ***D03C 3/38*** | (2006.01) |
| ***D03C 3/32*** | (2006.01) |
| *D03C 3/00* | (2006.01) |
| *D03C 13/00* | (2006.01) |

(52) U.S. Cl. ..... 139/86; 139/59; 139/1 C; 139/21; 139/85

(58) Field of Classification Search ..... 139/86, 139/59, 1 C, 85, 21
See application file for complete search history.

(56) References Cited

U.S. PATENT DOCUMENTS

| | | | | |
|---|---|---|---|---|
| 369,565 | A * | 9/1887 | Stafford | 139/86 |
| 373,151 | A * | 11/1887 | Northup | 139/86 |
| 1,527,928 | A * | 2/1925 | Scott | 28/212 |
| 1,603,480 | A * | 10/1926 | McGinn | 139/86 |
| 2,078,091 | A | 4/1937 | Matthews | |
| 3,724,512 | A | 4/1973 | Kohl | |
| 2002/0185191 | A1 | 12/2002 | Froment | |

FOREIGN PATENT DOCUMENTS

| | | |
|---|---|---|
| FR | 2711997 | 5/1995 |
| GB | 151761 | 10/1920 |
| GB | 1088044 | 10/1967 |

* cited by examiner

*Primary Examiner*—Robert Muromoto
(74) *Attorney, Agent, or Firm*—Dowell & Dowell P.C.

(57) ABSTRACT

A member for guiding harness cords of a Jacquard loom harness wherein the member is substantially planar and is provided with holes defining passages for the cords. At least one of these passages extends in a direction that is oblique with respect to a principal plane of the member. This arrangement makes it possible to reduce frictional forces undergone by the harness cords, particularly at the upper and lower edges of the holes.

17 Claims, 3 Drawing Sheets

GUIDING MEMBER, JACQUARD HARNESS INCORPORATING SUCH A MEMBER, PROCESS FOR MANUFACTURING SUCH A MEMBER AND WEAVING LOOM COMPRISING SUCH A MEMBER

BACKGROUND OF THE INVENTION

1. Field of the Invention

The present invention relates to a member for guiding the harness cords of a weaving loom harness of Jacquard type. It also relates to a Jacquard harness incorporating such a member, and to a process for manufacturing such a member. Finally, the invention relates to a weaving loom comprising such a member and/or such a harness.

2. Brief Description of the Related Art

In the domain of weaving looms of Jacquard type, it is known to guide harness cords constituting a harness by means of a perforated board disposed in the vicinity of the Jacquard system, i.e. in the upper part of the superstructure of the loom, and by means of a comberboard installed above the shed-forming zone, these two boards allowing the harness cords to be distributed in space. The harness cords thus follow angular paths defined by the holes that they traverse, in the perforated board and comberboard respectively. Taking into account the angles of these paths with respect to the vertical, considerable frictions are generated at the level of these holes, this causing overheating and premature wear of the harness cords.

In order to reduce this wear, it may be envisaged to work on the structure of the harness cords, as indicated in FR-A-2 711 997. However, the paths of the harness cords can be very tortuous, particularly for the cords intended to control the heddles close to the selvedges of the fabric. For these cords, the angles of inclination of the strands of the harness cords located above the comberboard are such that considerable localized stresses are exerted on these cords, this inducing forces of friction and high risks of rupture. In that case, the operational speed of the loom must be reduced, which leads to a loss of production.

It is also known from GB-A-151 761 to incline comberboards whose structure is conventional per se. A structure for guiding harness cords incorporating such inclined comberboards takes up considerable space in height. It induces complex adjustments and the use of sophisticated supports, which renders it expensive and cumbersome when used. Finally, this structure is not efficient if the cords have different inclinations between the Jacquard system and a given board.

It is a more particular object of the present invention to overcome these drawbacks by proposing a novel structure of a member for guiding harness cords, which limits overheating and risks of rupture of these cords while allowing higher performances of the loom.

SUMMARY OF THE INVENTION

In this spirit, the invention relates to a member for guiding the harness cords of a weaving loom harness of Jacquard type, this member being substantially planar and provided with holes for passage of these cords, characterized in that at least one of these holes extends in an oblique direction with respect to a principal plane of this member.

"Oblique" is understood to mean that the direction of the or each hole in question is neither perpendicular nor parallel to the principal plane of the guiding member.

Thanks to the oblique nature of the or each hole of the guiding member, which is advantageously a comberboard or a perforated board, the efforts of friction at the level of the upper edge or the or each oblique hole are substantially reduced thanks to a distribution of the angle of direction change between the upper and lower strands of the harness cords. The principal plane of the guiding member is, in practice, substantially parallel to the warp of the loom.

According to non-obligatory but advantageous aspects of the invention, this guiding member incorporates one or more of the following characteristics:

- the oblique direction of the hole is such that the angle between the upper strand, which extends between a Jacquard system and the guiding member, of a harness cord and the direction of the hole has a value less than that of the angle between this strand and an axis orthogonal to that plane.
- the oblique direction of the hole is substantially orthogonal to the bisectrix of the upper and lower strands of the harness cord which respectively extend between a Jacquard system and the afore-mentioned member and between this member and a heddle controlled by this cord, this direction being substantially coplanar with these strands.
- a plurality of holes extend in different oblique directions with respect to the principal plane of the member. This makes it possible to adapt the direction of the holes to the distribution in space of the strands of the harness cords, above and below this member. The holes may also be provided to be distributed over this member by zones in each of which the holes extend in directions making substantially the same angle with the afore-mentioned principal plane, this angle being different from one zone to another. This arrangement consists in providing, in the same zone, substantially identical bores whose obliqueness presents an average value such that it reduces the most critical harness deviations while increasing the weakest deviations. This is a positive compromise.
- the holes are arranged so that at least one harness cord traverses two holes, at least one of these two holes extending in an oblique direction with respect to the principal plane. In that case, the angles of obliqueness of these two holes may be provided to be different. These two holes may also be provided to communicate with at least one volume adapted to be placed in overpressure by its supply from a source of pressurized gas, these holes in that case constituting orifices for outlet of the gas with respect to this volume.

The invention also relates to a weaving loom harness of Jacquard type which comprises at least one guiding member as described hereinabove.

In addition, the invention relates to a weaving loom comprising at least one guiding member and/or one harness as described hereinbefore. Such a harness can operate at high speed without too great wear of its harness cords.

The invention also relates to a process for manufacturing a guiding member as described hereinabove and more specifically to a process of manufacture which comprises the steps consisting in:

a) determining the theoretical position of a hole in this member, b) calculating, for this hole, the angle of inclination of a strand of the harness cord traversing this hole, c) determining, for this hole, an angle of bore as a function of the previously calculated angle of inclination and of the position of the adjacent holes, bored or to be bored, and d) boring this hole at the angle determined in the preceding step.

According to an advantageous aspect of the invention, steps a) to c) are carried out between the successive bores of two holes in the guiding member, in order to adjust the angle of bore of each hole individually.

According to another approach, the process according to the invention comprises steps consisting in:

a') dividing the guiding member into a plurality of zones in which holes for passage of the cords are bored, b') determining for each hole the zone to which it belongs, and c') boring this hole at an angle oblique with respect to a principal plane of this member, this angle being identical for all the holes of the same zone and different from one zone to another.

According to an advantageous aspect of the invention, a step is carried out between steps c) and d) or between steps b') and c'), in which:

e) it is verified that the hole, bored at the angle determined in step c) or due to the hole belonging to a zone, is compatible with the adjacent holes, already bored or to be bored, and the parameters relative to the position of the hole and the angle of bore are possibly adapted as a function of the result of the verification.

In the event of interference between two adjacent holes, this makes it possible to modify the angle of bore determined in step c) or due to the hole belonging to a zone, particularly in order to avoid an intersection between two holes. In practice, steps a), b) and c) or a') and b') may be carried out for all the holes before boring begins. The parameters of position and of inclination of the holes are then memorized during each step a), b) or c), this facilitating monitoring of the interferences and the possible adjustment of these parameters.

BRIEF DESCRIPTION OF THE DRAWINGS

The invention will be more readily understood on reading the following description of three forms of embodiment of a guiding member in accordance with its principle and of a harness according to the invention equipping a Jacquard loom, given solely by way of example and made with reference to the accompanying drawings, in which.

DESCRIPTION OF PREFERRED EMBODIMENTS

Figure 1:
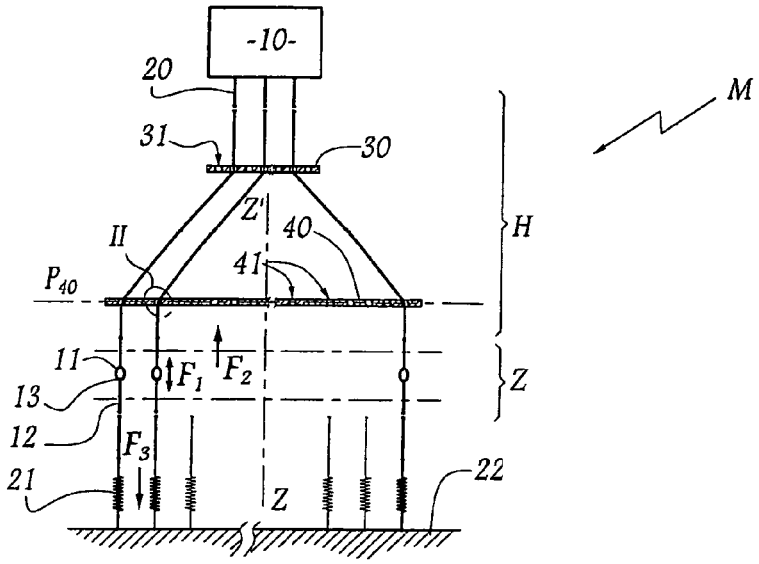
FIG. 1 schematically shows a Jacquard harness according to the invention mounted on a weaving loom.

Referring now to the drawings, the loom M shown in FIG. 1 is equipped with a Jacquard system 10 supported by a superstructure (not shown) above a zone Z in which the eyes 11 of heddles 12 are displaced, these eyes being traversed by the warp yarns 13 of the loom.

The heddles are animated by a substantially vertical oscillatory movement represented by the double arrow $F_1$. The heddles are subjected to efforts of traction $F_2$ and $F_3$ respectively exerted by the harness cords 20 and by springs 21 fixed to the frame 22 of the loom M.

The harness cords 20 belonging to a harness H are controlled by the system 10 and each follow a path between this system and the heddle 12 associated therewith. The path of each cord 20 is defined by a perforated board 30 disposed in the vicinity of the system 10, and by a comberboard 40 disposed above the zone Z and at a relatively short height with respect thereto. Elements 30 and 40 constitute members for guiding the cords 20.

The board 30 is provided with holes 31 for passage of the cords 20.

The board 40 is also provided with holes 41 that form passages for the cords 20. According to the invention, these passages are not all perpendicular to a plane $P_{40}$ median with respect to the board 40, this plane $P_{40}$ being a principal plane of the board 40 which is horizontal when the latter is installed as shown in FIG. 1.

Figure 2:
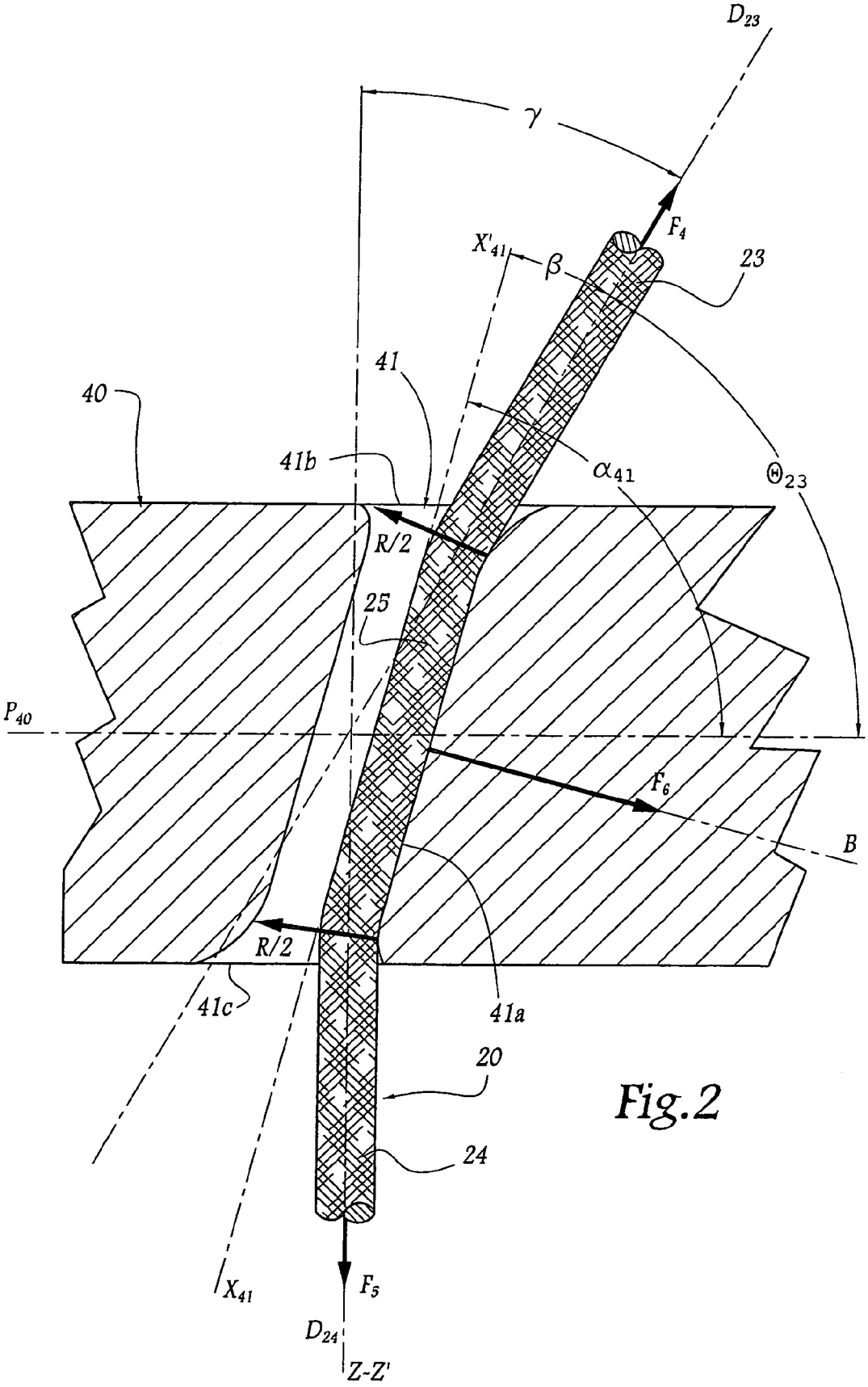
FIG. 2 is a view on a larger scale of detail II in FIG. 1.

With reference to FIG. 2, it will be noted that the hole 41 shown in this Figure extends in the direction of an axis $X_{41}$ which makes an angle $\alpha_{41}$ smaller than 90° with respect to the plane $P_{41}$ in the plane of FIG. 2 which contains the upper (23) and lower (24) strands of the cord 20.

The upper strand 23 of the cord 20 is the strand which extends above the board 40, i.e. between the system 10 and this board, passing through the board 30. The lower strand 24 is the strand which extends between the board 40 and the heddle 12 associated with the cord 20. An intermediate strand 25 is located inside the hole 41, in abutment against its lateral surface 41*a*. As a function of the movements of the cord 20, the parts of this cord constituting strands 23 to 25 vary.

Strand 25 makes a substantially identical angle with each of strands 23 and 24.

If $F_4$ denotes the effort of traction exerted on strand 23 by the system 10 and if $F_5$ denotes the effort exerted on strand 24 by the heddle 12, the effort $F_6$ exerted by the cord 20 on the board 40 is substantially perpendicular to the surface 41*a*. The reaction effort R exerted by the board 40 on the cord 20 depends on the effort $F_6$ and is essentially distributed at the level of the two upper (41*b*) and lower (41*c*) edges of the hole 41. In this way, the effort undergone by the cord 20 at the level of the zones of transition between strands 23 and 25 on the one hand, 24 and 25 on the other hand, has an intensity equal to about half the effort R.

In practice, depending on the angle $\alpha_{41}$ of inclination of the axis $X_{41}$ of the hole 41, the reaction effort R is distributed between the edges 41*b* and 41*c*. Each of the components of this effort exerted at the level of these edges has an intensity less than that of this effort.

Figure 3:
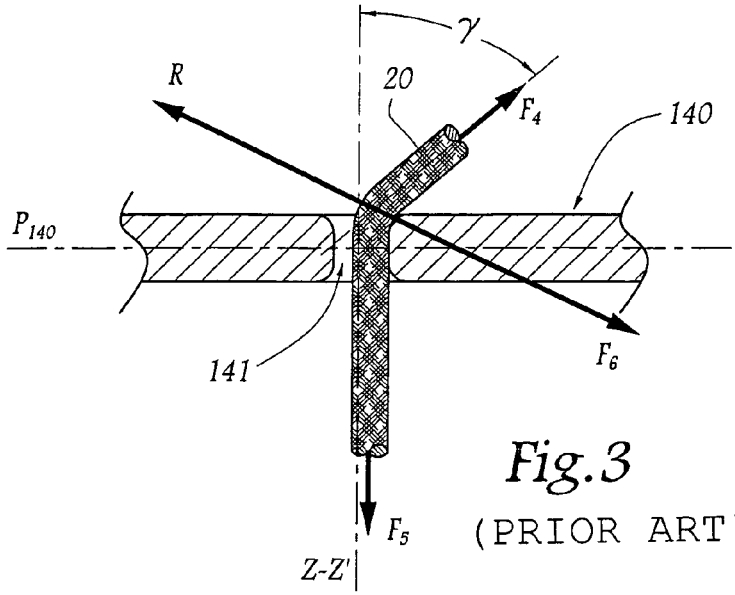
Fig.3 (PRIOR ART)
FIG. 3 is a view similar to FIG. 2 but on a smaller scale for a device of the prior art.

With reference to FIG. 3, it will be noted that, in the case of a conventional comberboard 140 where a hole 141 is substantially orthogonal to a principal plane $P_{140}$ of the board 140, the reaction effort R of the board is concentrated at the level of the upper edge of the orifice 141.

In this way, the inclined nature of the hole 41 makes it possible to distribute, over two edge zones, the intensity of the effort undergone locally by the harness cord 20 with a conventional board, this consequently increasing its life.

The direction of axis $X_{41}$ is advantageously chosen so that it is perpendicular to a bisector of two straight lines $D_{23}$ and $D_{24}$ centered on the strands 23 and 24 of the cord 20. This particular orientation of the hole 41 allows an optimum distribution of the forces of reaction and of friction.

In addition, the angle β between the strand 23 and the axis $X_{41}$ in FIG. 2 is smaller than the corresponding angle γ in FIG. 3, this angle γ being in fact equal to the angle between the upper strand of the harness cord and an axis Z–Z' perpendicular to the plane $P_{140}$.

In addition, the edges 41*b* and 41*c* of the hole 41 are conventionally rounded in order to limit the stresses at their respective levels.

In practice, the board 40 is manufactured as a function of the harness H to which it will belong. More specifically, when the number of cords of the harness H is known and when the type and position of the system 10 and of the board 30 are known, the distribution in space of the upper strands 23 of the cords 20 may be calculated, this making it possible to determine their respective angles $\theta_{23}$ with respect to plane $P_{40}$. It is then possible to determine, particularly by calculation by means of a computer, for each hole 41, its angle of inclination $\alpha_{41}$, with respect to plane $P_{40}$, as a function of its position and the angle $\theta_{23}$ previously determined.

Depending on the density of the bores, it is possible to anticipate possible interferences between adjacent holes by calculation. In that case compromises on the ideal theoretical values of position and of angle of bore of the holes can be made. These compromises may also be made in order to simplify the boring operations. It is then possible, thanks to a suitable machine such as a robot or a drill with adjustable head, to bore the hole $P_{41}$ with the previously determined angle $\alpha_{41}$.

Angle $\alpha_{41}$ may be determined for each hole 41, this enabling the orientation of these holes to be adapted precisely to the desired configuration of the harness.

Figure 4:
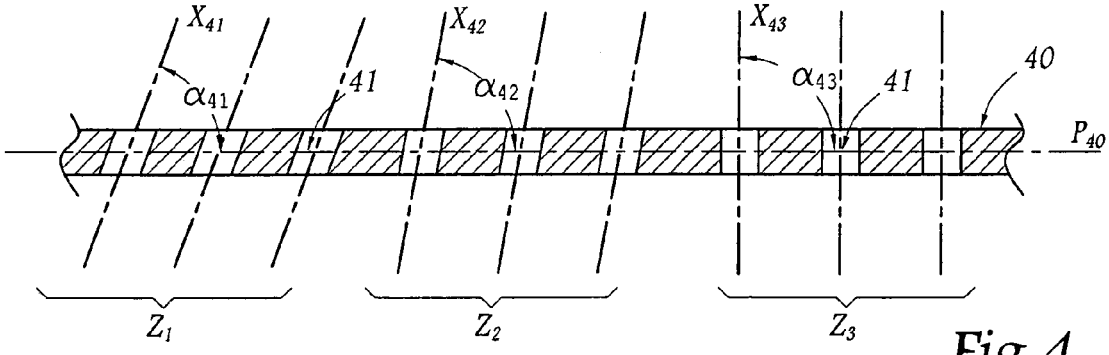
FIG. 4 is a schematic partial representation of the comberboard shown in FIG. 1.

As is more particularly visible in FIG. 4, it is also possible to distribute the holes 41 of the board 40 by zones $Z_1$, $Z_2$, $Z_3$, . . . in which the angle of inclination $\alpha_{41}$, $\alpha_{42}$ or $\alpha_{43}$ of their respective axes $X_{41}$, $X_{42}$ or $X_{43}$ is constant, this angle $\alpha_{41}$, $\alpha_{42}$, $\alpha_{43}$ being different from one zone to the other. Such a distribution simplifies manufacture of the board 40.

In that case, the distribution of the reaction of the board 40 on the harness cords is not necessarily balanced. However, the double deviation of the cords contributes, there again, to a reduction of their wear.

It will be noted that, in the zone $Z_3$ corresponding to the center of the board 40, the angle $\alpha_{41}$ may be equal to 90°.

In each zone $Z_1$, $Z_2$ or $Z_3$, the angles $\alpha_{41}$, $\alpha_{42}$ or $\alpha_{43}$ are adapted in order to reduce the deviation at the level of the upper edge of the holes 41. In practice, they may be chosen as a function of an average, on each zone, of the optimal angles described hereinabove.

Figure 5:
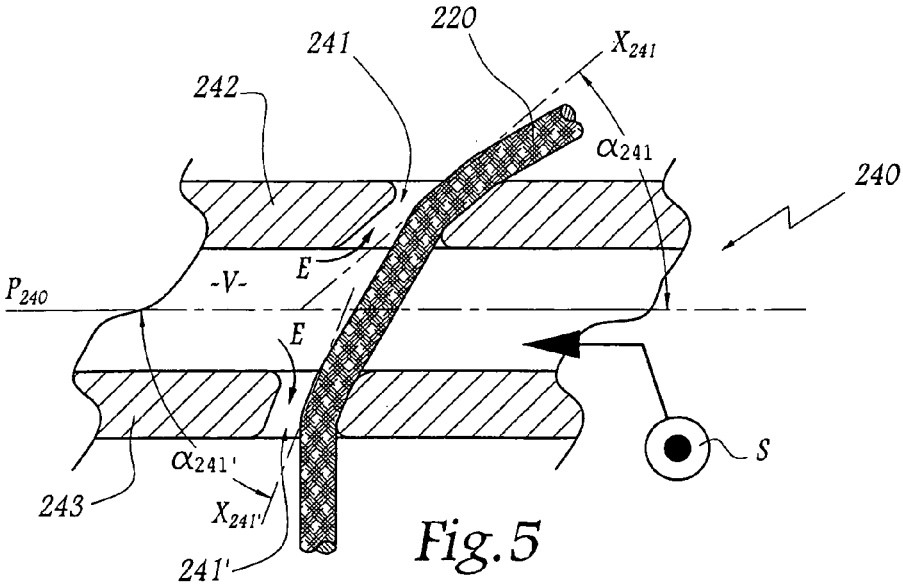
FIG. 5 is a view similar to FIG. 3 for a comberboard according to a second form of embodiment of the invention.

As shown in FIG. 5 for a second form of embodiment, the comberboard 240 may be formed by two panels 242 and 243 in each of which are respectively made holes 241 and 241' for passage of harness cords 220. Between the two panels 242 and 243 there is defined a volume V connected to a source S of compressed air, which allows a flow of air from the volume V towards the outside, as represented by arrows E. This allows the holes 241 to be permanently cleaned.

As previously, these holes extend in the direction of axes $X_{241}$ and $X_{241'}$ which are oblique with respect to the median plane $P_{240}$ of the board 240.

It will be noted that each cord 220 successively traverses a hole 241 and a hole 241' and that the angle $\alpha_{241}$ or $\alpha_{241'}$ of the axes $X_{241}$, and $X'_{241}$, of these two holes with respect to the plane $P_{240}$ is not forcibly the same.

Figure 6:
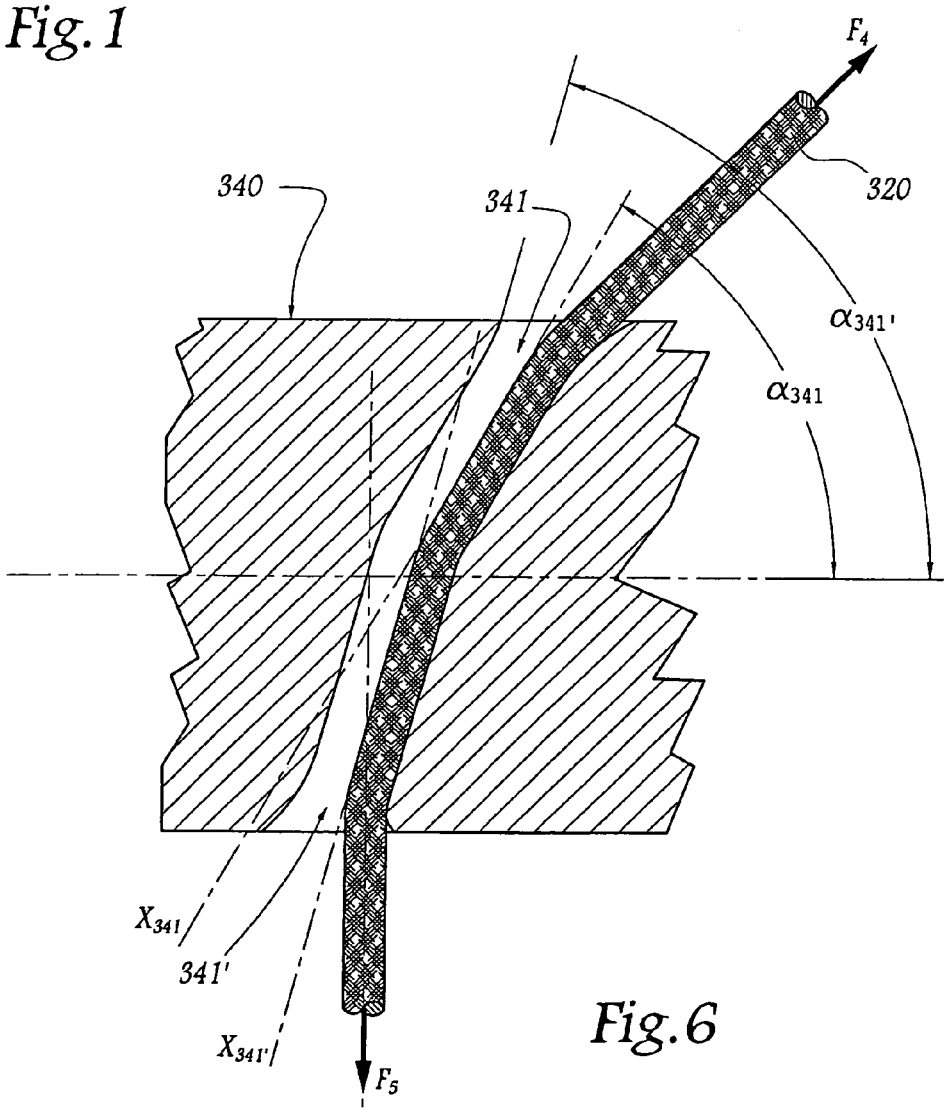
FIG. 6 is a view similar to FIG. 3 for a comberboard according to a third form of embodiment of the invention.

As shown in FIG. 6, a comberboard 340 may be made so that the hole has two passage sections 341 and 341' that are disposed directly in line with each other with axes $X_{341}$ and $X_{341'}$ oblique with respect to a median plane $P_{340}$, their angles of obliqueness $\alpha_{341}$ and $\alpha_{341'}$ being different. The harness cord 320 then changes direction in the thickness of the board 340 on passing from one of the passage sections to the other.

The invention has been shown when applied to a comberboard. It might also be implemented at the level of the perforated board 30 shown in FIG. 1.

The characteristics of the different forms of embodiment shown may be combined together within the framework of the present invention. In particular, the holes 241 and 241' of the embodiment of FIG. 5 may each be made like the double hole of FIG. 6, in which case the harness cord is subjected, in total, to six successive deviations.

In practice, the higher the number of deviations undergone by a cord, the less the cord is stressed.

What is claimed is:

1. A member for guiding harness cords of a weaving loom harness of Jacquard type, said member being substantially planar and provided with holes for passage of said cords, at least one of said holes defining a passage between an upper and lower surface of said member for passage of a harness cord and wherein at least a portion of said passage extends inwardly of said member from an upper edge of said at least one hole in an oblique angle with respect to a principal plane of said member and said upper surface of said member.

2. The member of claim 1, wherein the oblique direction of said passage is such that an angle between an upper strand of a harness cord, which extends between a Jacquard system and said member, and said direction has a value less than that of an angle between said upper strand and an axis orthogonal to said principal plane.

3. The member of claim 1, wherein the oblique direction of said passage is substantially orthogonal to a bisector of upper and lower strands of a harness cord which extends respectively between a Jacquard system and said member and between said member and a heddle controlled by said harness cord, said direction also being substantially coplanar with said upper and lower strands.

4. The member of claim 1, wherein a plurality of holes have passages that extend in different oblique directions with respect to said principal plane of said member.

5. The member of claim 4, wherein said holes are distributed on said member in a plurality of zones, said holes in each zone extend in directions making substantially the same angle with said principal plane, and said angle being different from one zone to another.

6. The member of claim 1, wherein said at least one hole includes at least two passages through which one harness cord extends, at least one of said two passages extending in a direction oblique with respect to said principal plane.

7. The member of claim 6, wherein each of said two passages extends at a direction oblique with respect to said principal plane and angles of obliqueness of said two passages are different.

8. The member of claim 6, wherein said two passages communicate with at least one internal volume of said member adapted to be placed under pressure from a source of pressurized gas, said passages constituting orifices for outlet of the pressurized gas with respect to said volume.

9. A weaving loom harness of Jacquard type comprising harness cords adapted to be controlled by a Jacquard system for the displacement of heddles, wherein said harness comprises at least one guiding member according to claim 1.

10. A weaving loom of Jacquard type including the harness of claim 9.

11. A weaving loom of Jacquard type including at least one member for guiding according to claim 1.

12. A process for manufacturing a member for guiding the harness cords of a weaving loom harness of Jacquard type, said member being substantially planar and provided with holes of defining passages through which said cords extend are and which holes are bored in said member, wherein the method comprises steps consisting in:

a) determining a theoretical position of a hole in said member, b) calculating, for said hole, an angle of inclination of a strand of the harness cord traversing said passage, c) determining, for said hole passage, an angle of bore as a function of the angle of inclination calculated in step b) and of the position of adjacent holes that are bored or are to be bored, and d) boring said hole at the angle determined in step c).

13. The process of claim 12, including carrying out steps a) to c) between successive passages defined by at least one hole in said member, in order to adjust the angle of bore of each hole passage individually.

14. The process of claim 12, wherein including a step carried out between steps c) and d) in which:

e) verifying that said hole, bored at said angle of bore or due to the hole being within a zone, is compatible with the adjacent holes, already bored or to be bored, and parameters relative to a position of said hole and said angle of bore are adapted as a function of the result of the verification.

15. A process for manufacturing a member for guiding harness cords of a weaving loom harness of Jacquard type, said member being substantially planar and provided with holes defining passages for harness cords through said member, comprising the steps of:

a') dividing said member for guiding into a plurality of zones in which holes for passage of said cords are bored, b') determining for each hole the zone to which it belongs, and c') boring at least a plurality of said holes at an angle of bore oblique with respect to a principal plane of said member, said angle of bore being identical for all the holes of the same zone and different from one zone to another.

16. The process of claim 15, further comprising a step carried out between steps b') and c') including:

e') verifying that said holes, bored at said angle of bore or due to the holes belonging to a common zone, are compatible with the adjacent holes, already bored or to be bored, and that parameters relative to the position of said holes and said angles of bore are adapted as a function of the result of the verification.

17. The member of claim 1 wherein said passage includes at least two passage sections that are angled relative to one another.

* * * * *